United States Patent [19]

Fischbein et al.

[11] 4,219,919

[45] Sep. 2, 1980

[54] JEWELRY CONNECTOR

[75] Inventors: Miklos Fischbein; Herman Benedek, both of Brooklyn, N.Y.

[73] Assignee: Elegant Merchandising, Inc., New York, N.Y.

[21] Appl. No.: 945,905

[22] Filed: Sep. 26, 1978

[51] Int. Cl.[3] ..... B25B 27/00

[52] U.S. Cl. ..... 29/270; 81/5.1 R; 81/425 R

[58] Field of Search ..... 29/268, 270, 283.5; 81/5.1 R, 418, 419, 425 R, 425 A, 426, 427; 59/93; 72/410; 24/129 W, 20 CW, 20 W, 23 W; 403/341, 313, 309, 284

[56] References Cited

U.S. PATENT DOCUMENTS

| | | | |
|---|---|---|---|
| 1,283,062 | 10/1918 | Brooks | 24/23 W |
| 2,269,285 | 1/1942 | Ott | 24/23 W |
| 3,120,773 | 2/1964 | Esser | 81/5.1 R |
| 3,421,341 | 1/1969 | Hodge | 63/4 |
| 3,879,981 | 4/1975 | Richards | 81/5.1 R |

FOREIGN PATENT DOCUMENTS

| | | | |
|---|---|---|---|
| 555163 | 3/1923 | France | 72/410 |

*Primary Examiner*—James L. Jones, Jr.
*Attorney, Agent, or Firm*—McAulay, Fields, Fisher, Goldstein & Nissen

[57] ABSTRACT

The present invention is directed to the combination of an article of jewelry and a connecting means therefore in which the article of jewelry comprises a chain having a plurality of spaced indentations along the side edges thereof. A clasp member is adapted to be connected to the end of the chain wherein the clasp member comprises a first portion having a passage defined by opposed sidewalls and a second portion having a terminal end. The passage receives the chain therein with the side edges of the chain adjacent the opposed sidewalls of the clasp member. The connecting means comprises a plier having opposed jaws which are movable toward and away from each other. A recess is provided in the opposed jaws which is sized to receive the passage portion of the clasp member therein. A plurality of projections are provided in the recess which have the same spacing as the indentations on the chain. The projections are engagable with the sidewalls of the clasp member to press portions of the sidewalls into the chain indentations as the jaws are moved toward each other to firmly affix the clasp member to the chain.

14 Claims, 7 Drawing Figures

JEWELRY CONNECTOR

The present invention relates generally to a jewelry connector and, more particularly, pertains to a device for connecting a clasp to a decorative chain.

At present, jewelry in the form of decorative chains are gaining widespread popularity. These chains are fabricated from a precious metal such as gold or the like. The ends of the chains terminate in complimentary clasp members which are adapted to be connected together so the chain can be worn around the neck. However, a severe drawback is associated with these types of chains.

To be more specific, the clasp members are presently soldered to the chains and thereby require the services and entail the expense of a skilled artisan. Since these chains are cut to the specific length desired by the customer, the chains are normally sold in rolls of about 50–100 feet. Accordingly, the problem is minimized in those stores that make up jewelry to order since the soldering can be performed on the premises. However, the soldering process still requires time and effort since the joint must be cleaned, filed, etc. On the other hand, the greater majority of jewelry stores have no facilities for soldering, etc. and therefore must stock differently sized ready-to-wear chains. It is obvious that this would require an enormous outlay of money thereby tying up needed capital.

Accordingly, it is an object of the present invention to provide an improved device for connecting clasp members to a decorative chain to provide an article of jewelry.

A more specific object of this invention is to provide a connecting device for connecting a clasp member to a chain that is simple to use by unskilled labor.

Another object of the present invention resides in the novel details of construction that provide a device of the type described that is economical to manufacture and efficient in operation.

Accordingly, a connecting means constructed according to the present invention is adapted to be used to connect a clasp member to a decorative chain to provide an article of jewelry in which the chain is provided with spaced indentations along the side edges and the clasp member is provided with a chain receiving portion defined, in part, by opposed sidewalls and a terminal end portion. The device comprises a plier having a pair of handle and jaw sections rotatably connected together whereby the jaw sections are movable toward and away from each other. Aligned open-ended slots are provided in the jaw sections which define a recess adapted to receive the clasp member therein with the bottom wall of the slots in facing relationship to the sidewalls of the clasp member. A plurality of projections are provided on the bottom wall which have the same spacing as the chain indentations whereby movement of the jaws toward each other deforms the walls of the clasp member into the indentations thereby to fixedly connect together the clasp member and the chain.

A feature of the present invention is to provide the combination of the chain, a clasp member and a connecting means for connecting the clasp member to the chain by a deformation process thereby to eliminate the need for soldering or other similar techniques.

Other features and advantages of the present invention will become more apparent from a consideration of the following detailed description when taken in conjunction with the accompanying drawing, in which.

Figure 1:
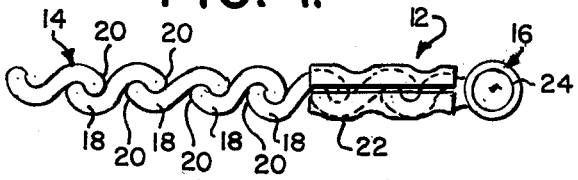
FIG. 1 is a top plan view of an article of jewelry, to an enlarged scale, fabricated in accordance with the present invention.

A connector or connecting device constructed according to the present invention is designated generally by the reference character 10 in the FIGS. and is adapted to be utilized in conjunction with an article of jewelry of the general type designated by the reference numeral 12 in FIG. 1. More specifically, the article of jewelry 12 comprises a chain 14 and a clasp member 16 connected to one end of the chain. A complementary formed clasp member is connected to the other end of the chain (not shown) and is adapted to engage with the clasp member 16 in the conventional manner so that the chain forms a closed loop adapted to be worn about the neck of the wearer.

The chain comprises individual links 18 having a contoured surface. In particular, the links 18 are so-called "S"-shaped links which are connected together at their distal ends. In the conventional manner, the links are connected so that they are pivotable with respect to each other. In view of the contours of the links 18, the chain 14 is formed with regularly spaced indentations 20 along the side edges of the chain. However, as shown in FIG. 1, the indentations on one side of the chain are offset with respect to the indentations 20 on the other side of the chain.

The clasp member 16 is formed with a chain-receiving passage portion 22 that receives the end of the chain therein and a terminal end portion 24 in the shape of a ring. It is to be understood that the clasp member at the other end of the chain would include a portion that extends through the ring portion 24 to connect the two ends of the chain together. Prior to the present invention, the clasp member 16 would be connected to the chain 14 by a soldering process or the like thereby requiring the services of an artisan and increasing the cost of the article in addition to requiring preparation of the elements for the actual soldering. However, in accordance with the present invention, the clasp member 16 is connected to the chain 14 by use of the connector 10 in a simple and efficient manner which does not require the use of skilled labor.

Figure 2:
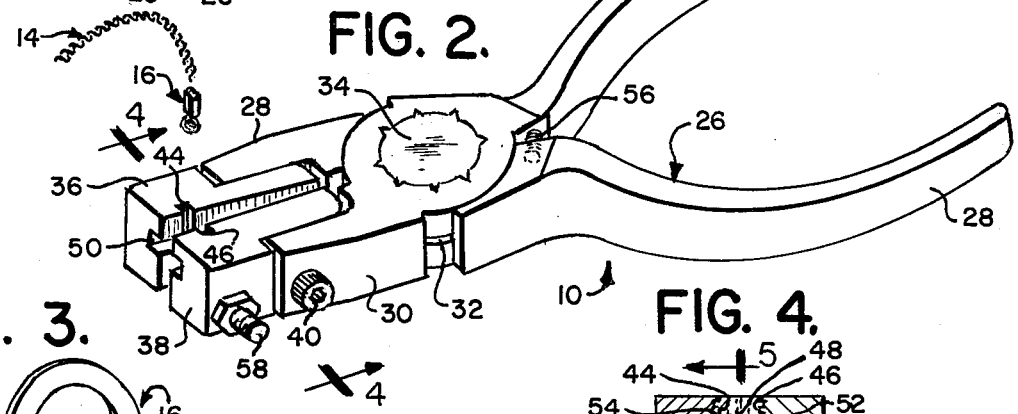
FIG. 2 is an exploded perspective view of a connector constructed according to the present invention, illustrating the relationship between the connector and the elements comprising the article of jewelry.
Figure 4:
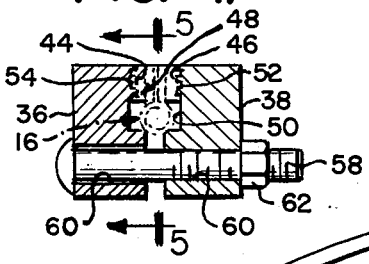
FIG. 4 is a sectional view taken along the line 4—4 of FIG. 2.
Figure 5:
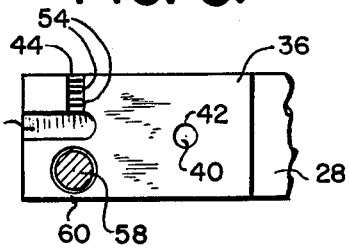
FIG. 5 is a sectional view taken along the line 5—5 of FIG. 4.

More particularly, as shown in FIGS. 2, 4 and 5, the connector 10 comprises a plier 26 having handle portions 28 and 30. The handle portions 28 and 30 are provided with complementary formed central recesses 32 so that the handle portions may be connected together in nesting relationship in the conventional manner. A rivet 34 extends through the central portion of the handle portions and rotatably connects together the handle portions. The handle portions 28 and 30 terminate in opposed jaw sections 36 and 38 which are removably secured to the respective handle portions by set screws 40 which extend through the respective handle portions and are threadedly received in appropriate bores 42 in the jaw sections.

The jaw sections 36 and 38 are provided with aligned open-ended respective slots 44 and 46 which extend vertically downwardly from the top surface of the jaw sections. The slots form a recess 48 as the jaw sections are brought together. The recess is adapted to receive the passage portion 22 of the clasp member 16 as noted in detail below. The bottom end of the slots 44 and 46 terminate in a horizontally extending slot or recess 50 in the jaw sections. A plurality of vertically spaced projections 52 are provided on the bottom wall of the slot 46 and a similar plurality of vertically spaced projections 54 are provided on the bottom wall of the slot 44. The spacing between the projections 52 and the spacing between the projections 54 correspond to the spacings or distances between the indentations 20 on the chain 14. Moreover, the projections 52 and 54 are offset with respect to each other similarly to the offset between the indentations 20 of the chain 14.

As shown in FIG. 2, spring 56 extends between the handle portions 28 and 30 adjacent the junction between the handle portions and biases the handle portions and, therefore, the jaw sections away from each other. A stop in the form of a screw 58 is slidingly received in aligned bores 60 in the jaw sections 36 and 38 and threadedly receives a nut 62 on the end thereof. Accordingly, the nut 62 and the head of the screw 58 limit the extent of movement of the jaw sections away from each other.

Figure 3:
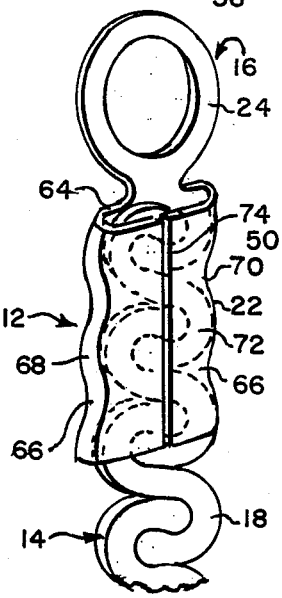
FIG. 3 is a detail view, to an enlarged scale, showing the connection of a clasp member to a chain using the connector of the present invention.

As shown in FIGS. 1 and 3, the passage portion 22 of the clasp member 16 is defined by a bottom wall 64 which has outwardly extending ears 66. The ears 66 are bent upwardly to form opposed sidewalls 68, 70 and are then bent at right angles to the sidewalls in overlying relationship to the bottom wall to form a top wall 72. The ends of the ears 66 terminate in spaced relationship to each other to form a longitudinally extending opening 74 for the reasons noted below.

In operation, a clasp member 16 is inverted (i.e., with the terminal end portion 24 extending downwardly) into the recess 48 defined by the open ended slots 44 and 46. The bottom wall of the recess 50 engages the terminal end portion 24 to provide a seat for the clasp member, as shown in phantom in FIG. 4. In other words, the opening between the jaw sections is adjusted by the nut 62 so that the clasp member will engage the bottom wall of the recess 50 when the member is inserted into the recess 48 rather than falling between the jaw sections. The recesses 48 and 50 are sized so that when the clasp member 16 is seated on the bottom wall of the recess 50, the sidewalls 68 and 70 of the clasp member will be positioned adjacent the bottom walls of the slots 44 and 46.

The end of the chain 14 is then placed into the passage 22 in the clasp member 16 and the handles 28 and 30 are brought together thereby causing the jaw sections to move toward each other. Accordingly, the projections 52 and 54 engage the sidewalls of the clasp member 16 and press the portions of the wall immediately adjacent thereto into the indentations 20 in the chain 14. In other words, the projections deform the portions of the sidewalls of the member 16 immediately adjacent thereto so that the sidewalls match the contours of the side edges of the chain, as shown in FIGS. 1 and 3. The opening 74 in the clasp member 16 permits sufficient flexibility so that the clasp member 16 does not buckle outwardly. Additionally, the depth of the slots 44 and 46 is sized so that the chain will not be crushed when the projections press the sidewalls of the member 16 inwardly. Moreover, the recess 50 is sized and positioned so that when the jaw members or sections are brought together, the sidewalls of the recess 50 will still be in spaced relationship to the terminal end portion 24 so that the portion 24 is not affected. Thus, when the chain 14 is removed from the connector 10, the clasp member 16 will be firmly affixed thereto in a tight mechanical connection and cannot be removed therefrom.

Since the chains 14 are normally provided in different sizes, similar differently sized recesses will be required to accommodate the different chain sizes and the associated differently sized clasp members. Thus, a plurality of differently sized jaw sections may be provided which are easily connected to the handle portions 28 and 30 by removing the screws 40 from the jaw sections already attached to the handle portions and replacing said jaw sections with the new set of sections.

Accordingly, a connector has been disclosed for easily connecting a clasp member to an undulating chain in a simple and efficient manner without the need for skilled personnel.

Figure 6:
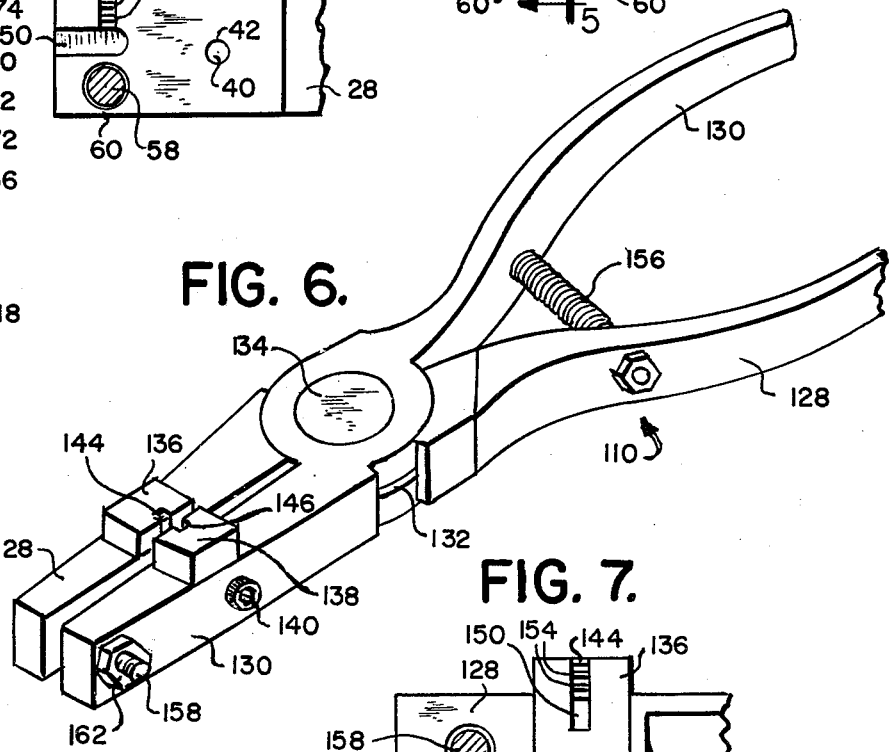
FIG. 6 is a perspective view of a modified embodiment of a connector constructed according to the present invention.
Figure 7:
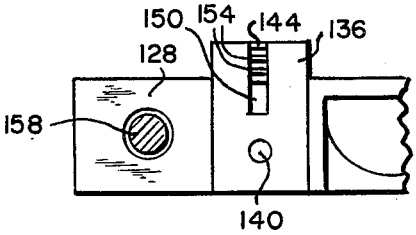
FIG. 7 is a detail view of a jaw portion of the connector shown in FIG. 6.

FIGS. 6 and 7 illustrate a modified embodiment of a connector 110 constructed according to the present invention. The connector 110 includes handle portions 128 and 130 which are recessed at 132 and connected in nesting relationship via a rivet 134 which permits the handle portions to move relative toward each other. A spring 156 extends between the handle portions and serves to bias apart the handle portions. The difference between the connector 10 and the connector 110 resides in the fact that the jaw sections 136 and 138 of the connector 110 are connected to the handle portions adjacent the ends thereof rather than at the ends. Similarly to the connector 10, the jaw section 136 and 138 are removably secured to the respective handle portions 128 and 130 via set screws 140. A screw 158 extends through the end of the handle portions and a nut 162 limits movement of the jaw sections away from each other. The jaw sections 136 and 138 are provided with opposed aligned open-ended slots 144 and 146 similarly to the slots 44 and 46 and function in the same manner. However, instead of a horizontally extending recess 50, an enlarged recess 150 is provided adjacent the bottom of the slots 144 and 146 and is adapted to receive the terminal end portion 24 of a clasp member 16 therein in a manner similarly to the recess 50 of the connector 10.

While preferred embodiments of the present invention have been shown and disclosed herein it will become obvious that numerous omissions, changes and additions may be made in such embodiments without departing from the spirit and scope of the present invention.

What is claimed is:

1. The combination of an article of jewelry and connecting means therefor, comprising:

a chain having a plurality of regularly spaced indentations spaced apart a predetermined distance along the side edges thereof;

a clasp member adapted to be connected to the end of said chain, said clasp member comprising a first portion having a passage defined in part by opposed sidewalls, and a second portion having a terminal end integral therewith, said passage receiving said chain therein with said side edges thereof adjacent said opposed sidewalls;

said connecting means comprising a plier having opposed jaws movable toward and away from each other, a recess in said opposed jaws sized to receive said first portion of said clasp member therein, and a plurality of projections in said recess having the same predetermined spaced apart relation as said indentations on said chain to be operable when said jaws are moved toward each other to engage and deform said sidewalls into said chain indentation, to affix said clasp member to said chain, thereby to provide a clasp member at the end of a jewelry chain.

2. A combination as in claim 1, in which said chain comprises a plurality of interconnected contoured links wherein said indentations are formed by the junction of adjacent links.

3. A combination as in claim 2, in which said links are S-shaped.

4. A combination as in claim 1, in which said clasp member first and second portions are integral, said first portion comprising a bottom wall having outwardly extending ears bent upwardly and toward each other in overlying relationship to said bottom wall to define said passage, said ears terminating in spaced relationship to each other to facilitate deformation of said sidewalls, said second portion lying in the same plane as said bottom wall, to be substantially colinear with said chain, when affixed to said chain.

5. A combination as in claim 1, in which said plier comprises a handle portion connected to each of said opposed jaws, said handle portions having recesses adapted to receive a complementary formed portion of the other handle so said complementary formed portions are adapted to be connected together in nesting relationship, and fastening means for rotatably connecting together said handle portions.

6. A combination as in claim 1, and biasing means for biasing said jaws away from each other.

7. A combination as in claim 1, and stop means for limiting movement of said jaws away from each other.

8. The combination of an article of jewelry and connecting means therefore comprising:

a chain having a plurality of spaced indentations along the side edges thereof; and a clasp member adapted to be connected to the end of said chain;

said clasp member comprising a first portion having a passage defined in part by opposed sidewalls, and a second portion having a terminal end, said passage receiving said chain therein with said side edges thereof adjacent said opposed sidewalls;

said connecting means comprising a plier having opposed jaws movable toward and away from each other, a recess in said opposed jaws sized to receive said first portion of said clasp member therein, and a plurality of projections in said recess having the same spacing as said indentations on said chain and engagable with said sidewalls of said clasp member to press portions of said sidewalls into chain indentations as said jaws are moved toward each other to affix said clasp member to said chain;

said recess further comprising aligned vertically extending open-ended slots in said jaws, the bottom wall of each of said slots having said projections thereon, and a second recess positioned below said slots and adapted to receive said second portion of said clasp member therein, said second recess having a bottom wall engagable with said second portion to provide a seat therefor when said first portion is correctly positioned in said slots.

9. A combination as in claim 8, in which said plier comprises a handle portion for each of said jaws, and means for removably connecting each one of said jaws with a respective one of said handle portions.

10. A device for connecting a clasp member having a terminal end portion with a height equal to a first predetermined distance to the end of a decorative chain, to provide an article of jewelry in which said chain is provided with indentations along the side edges spaced apart a second predetermined distance, and said clasp member being provided with a chain receiving passage portion defined in part by opposed sidewalls and a terminal end portion; said device comprising:

a plier having a pair of handle and jaw sections rotatably connected together whereby said jaw sections are movable toward and away from each other;

aligned open-ended slots in said jaw sections defining a recess adapted to receive the clasp member therein with the bottom wall of said slots in facing relationship to sidewalls of said clasp member; and a plurality of projections on said bottom wall being spaced apart said second predetermined distance to be operable to deform the walls of said clasp member into the indentations of the chain and fixedly connect together the clasp member and the chain, when said jaws are moved together with a chain and clase member properly in place therein, said jaw sections defining a second recess positioned below said slots and operable to receive the terminal end portion of the clasp member when the passage portion is received in said open-ended slots.

11. A device as in claim 10, and means to removably connect each jaw to the respective handle section.

12. A device as in claim 10, and biasing means to bias said jaws away from each other.

13. A device as in claim 10, in which the bottom wall of said second recess is spaced below the end of said open-ended slots by a distance substantially equal to the first predetermined distance to provide a seat for the clasp member.

14. A device as in claim 13, and stop means to limit movement of said jaws away from each other.

* * * * *